US007884064B2

(12) United States Patent
Bernhardt et al.

(10) Patent No.: US 7,884,064 B2
(45) **Date of Patent: *Feb. 8, 2011**

(54) LIGHT DUTY LIQUID DETERGENT COMPOSITIONS OF SULFONATED ESTOLIDES AND OTHER DERIVATIVES OF FATTY ACIDS

(75) Inventors: Randal J. Bernhardt, Antioch, IL (US); Lourdes R. Alonso, Deerfield, IL (US); Gregory P. Dado, Chicago, IL (US); Ronald A. Masters, Glenview, IL (US)

(73) Assignee: Stepan Company, Northfield, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/506,977

(22) Filed: Jul. 21, 2009

(65) Prior Publication Data

US 2010/0184633 A1 Jul. 22, 2010

Related U.S. Application Data

(63) Continuation-in-part of application No. PCT/US2009/031608, filed on Jan. 21, 2009.

(51) Int. Cl.
*C11D 1/28* (2006.01)

(52) U.S. Cl. ..... 510/495; 554/96

(58) Field of Classification Search ..... 510/495; 554/96

See application file for complete search history.

(56) References Cited

U.S. PATENT DOCUMENTS

| | | | |
|---|---|---|---|
| 2,581,375 | A | 1/1952 | De Groote et al. |
| 2,743,288 | A | 4/1956 | Rueggeberg et al. |
| 2,995,524 | A | 8/1961 | Wylie et al. |
| 3,332,880 | A | 7/1967 | Kessler et al. |
| 3,377,290 | A | 4/1968 | Werner et al. |
| 3,664,961 | A | 5/1972 | Norris |
| 3,668,153 | A | 6/1972 | Crotty |
| 3,898,187 | A | 8/1975 | Miller |
| 3,929,678 | A | 12/1975 | Laughlin et al. |
| 4,228,044 | A | 10/1980 | Cambre |
| 4,435,307 | A | 3/1984 | Barbesgaard et al. |
| 4,438,025 | A | 3/1984 | Satsuki et al. |
| 4,507,219 | A | 3/1985 | Hughes |
| 4,548,744 | A | 10/1985 | Connor |
| 4,561,998 | A | 12/1985 | Wertz et al. |
| 4,597,898 | A | 7/1986 | Vander Meer |
| 4,663,071 | A | 5/1987 | Bush et al. |
| 4,816,188 | A | 3/1989 | Kitano et al. |
| 4,936,551 | A | 6/1990 | Behler et al. |
| 5,002,683 | A | 3/1991 | Behler et al. |
| 5,071,594 | A | 12/1991 | Borland et al. |
| 5,075,501 | A | 12/1991 | Borland et al. |
| 5,294,726 | A | 3/1994 | Behler et al. |
| 5,329,030 | A | 7/1994 | Schenker et al. |
| 5,429,684 | A | 7/1995 | Osberghaus et al. |
| 5,441,156 | A | 8/1995 | Fabry et al. |
| 5,466,394 | A | 11/1995 | de Buzzaccarini et al. |
| 5,576,282 | A | 11/1996 | Miracle et al. |
| 5,622,925 | A | 4/1997 | de Buzzaccarini et al. |
| 5,679,630 | A | 10/1997 | Baeck et al. |
| 5,776,872 | A | 7/1998 | Giret et al. |
| 5,883,062 | A | 3/1999 | Addison et al. |
| 5,906,973 | A | 5/1999 | Ouzounis et al. |
| 5,929,022 | A | 7/1999 | Velazquez |
| 6,017,871 | A | 1/2000 | Baeck et al. |
| 6,018,063 | A | 1/2000 | Isbell |
| 6,048,836 | A | 4/2000 | Romano et al. |
| 6,172,026 | B1 | 1/2001 | Ospinal |
| 6,242,406 | B1 | 6/2001 | Katsuda et al. |
| 6,294,513 | B1 | 9/2001 | Jensen et al. |
| 6,306,812 | B1 | 10/2001 | Perkins et al. |
| 6,326,348 | B1 | 12/2001 | Vinson et al. |
| 6,605,579 | B1 | 8/2003 | Arvanitidou et al. |
| 6,627,592 | B1 | 9/2003 | Shamayeli |
| 6,797,011 | B2 | 9/2004 | Blangiforti |
| 6,878,695 | B2 | 4/2005 | Woo et al. |
| 6,903,064 | B1 | 6/2005 | Kasturi et al. |
| 6,949,498 | B2 | 9/2005 | Murphy et al. |
| 6,953,849 | B2 | 10/2005 | Vali |
| 7,326,675 | B2 | 2/2008 | Schneiderman et al. |

(Continued)

FOREIGN PATENT DOCUMENTS

| | | |
|---|---|---|
| DE | 2247832 | 4/1973 |
| DE | 3926345 A1 | 2/1991 |
| EP | 0070077 | 1/1983 |
| EP | 0075996 | 4/1983 |
| EP | 0094118 | 11/1983 |
| EP | 111965 | 6/1984 |
| EP | 111984 | 6/1984 |
| EP | 112592 | 7/1984 |
| EP | 0485500 A1 | 5/1992 |
| EP | 0 511 091 A1 | 10/1992 |

(Continued)

OTHER PUBLICATIONS

A.J. Stirton, et al.: "Surface-active properties of salts of alpha-sulphonated acids and esters" Journal of the American Oil Chemists' Society, vol. 13, No. 1, Jan. 1954, pp. 13-16, XP002537683 Springer, Berlin, DE ISSN: 0003-021X DOI: 10.1007/BF02544763 The Whole Document.

(Continued)

*Primary Examiner*—John R Hardee
(74) *Attorney, Agent, or Firm*—McAndrews, Held & Malloy, Ltd.

(57) ABSTRACT

Light duty liquid detergent formulations that contain sulfo-estolide surfactants, sulfo-estolide derivatives and salts of sulfo-estolides are disclosed. The compositions of the presently described technology are useful for soil removal applications including, but not limited to, washing dishes by hand.

36 Claims, No Drawings

U.S. PATENT DOCUMENTS

| | | | | |
|---|---|---|---|---|
| 7,666,828 | B2 * | 2/2010 | Bernhardt et al. | 510/495 |
| 2002/0039979 | A1 | 4/2002 | Aszman et al. | |
| 2002/0187909 | A1 | 12/2002 | Gupta et al. | |
| 2004/0071653 | A1 | 4/2004 | Bratescu et al. | |
| 2004/0242920 | A1 | 12/2004 | Dado et al. | |
| 2005/0215456 | A1 | 9/2005 | Goo et al. | |
| 2007/0128129 | A1 | 6/2007 | Stehr | |
| 2007/0202069 | A1 | 8/2007 | Tamareselvy | |
| 2008/0015135 | A1 | 1/2008 | Debuzzaccarini | |
| 2009/0054294 | A1 | 2/2009 | Theiler | |

FOREIGN PATENT DOCUMENTS

| | | | |
|---|---|---|---|
| GB | 1 047 772 | A | 11/1966 |
| GB | 1082179 | | 9/1967 |
| GB | 1278421 | A1 | 6/1972 |
| GB | 1372034 | | 10/1974 |
| GB | 1 380 390 | A | 1/1975 |
| GB | 2075028 | | 11/1981 |
| GB | 2095275 | | 9/1982 |
| GB | 2247832 | | 3/1992 |
| WO | 88/09367 | | 12/1988 |
| WO | 89/09813 | | 10/1989 |
| WO | WO 90/02116 | A1 | 3/1990 |
| WO | WO 91/02045 | A1 | 2/1991 |
| WO | WO 91/13961 | A1 | 9/1991 |
| WO | 92/05249 | | 4/1992 |
| WO | WO 92/15660 | A1 | 9/1992 |
| WO | 99/05242 | | 2/1999 |
| WO | 00/18363 | A1 | 4/2000 |
| WO | 00/58430 | A1 | 10/2000 |
| WO | 01/53247 | A1 | 7/2001 |
| WO | 2005/113735 | A1 | 12/2005 |
| WO | 2006/062665 | | 6/2006 |
| WO | WO 2006/062665 | * | 6/2006 |
| WO | 2008/137769 | | 11/2008 |
| WO | 2009/094336 | | 7/2009 |
| WO | WO 2009/094336 | * | 7/2009 |

OTHER PUBLICATIONS

PCT International Search Report and Written Opinion from International Application No. PCT/US2009/031455 mailed on Aug. 17, 2009.

PCT International Search Report and Written Opinion from International Application No. PCT/US2009/031608 mailed on Oct. 29, 2009.

PCT International Search Report and Written Opinion from International Application No. PCT/US2009/051299 mailed on Oct. 20, 2009.

PCT International Search Report and Written Opinion from International Application No. PCT/US2009/051318 mailed on Oct. 22, 2009.

PCT International Search Report and Written Opinion from International Application No. PCT/US2009/051319 mailed on Oct. 20, 2009.

PCT International Search Report and Written Opinion from International Application No. PCT/US2009/051464 mailed on Oct. 22, 2009.

"Surface Active Agents and Detergents" (vol. I and II by Schwartz, Perry and Berch).

Surfactant Science Series, Marcel Dekker, vol. 25 and 48.

Foams Fundamentals and Applications in the Petrochemical Industry, edited by Laurier L. Schraman (1994).

Handbook of Water-Soluble Gums and Resins, Glossary and Chapters 3, 4, 12 and 13, Robert L Davidson, McGraw-Hill Book Co., New York, NY (1980).

Stein et al., J. Amer. Oil Chemists Soc., 52:323-329 (1975).

Knaggs et al., J. Amer. Oil Chemists Soc., 42(9):805-810 (1965).

Kato et al., J. Surfactants and Detergents, 6(4):331-337 (2003).

Kirk-Othmer, Encyclopedia of Chemical Technology, 5th ed., vol. 23, Wiley-Interscience, Hoboken, NJ (2007), "Sulfonation and Sulfation", pp. 513-562.

McCutcheons' 2009 Functional Materials of North American Edition, vol. 2, pp. 239-246 (2009).

Neiditch et al., J. Amer. Oil Chemists Soc., 57(12):426-429 (1980).

Office Action in U.S. Appl. No. 12/353,751, dated Dec. 1, 2009.

Office Action in U.S. Appl. No. 12.353,751, dated Nov. 17, 2009.

Surfactant Science Series, Marcel Dekker, vols. 25 and 48.

Steinberg, Preservatives for Cosmetics Manual, 2nd Ed., by David S. Steinbens (2006).

Sauls et al., J. Amer. Oil Chemists Soc., 33(9):383-389 (1956).

SDA "Washers and Detergents" publication 2005; http://www.cleaning101.com/laundry/HE.pdf.

Surfactants and Interfacial Phenomena, 3rd ed., by Milton Rosen, published by John Wiley & Sons, Inc., Hoboken, NJ (2004).

European Search Report in EP 09009490.5, dated May 17, 2010.

International Search Report and Written Opinion in PCT/US09/51312, dated Mar. 24, 2010.

International Search Report and Written Opinion in PCT/US10/29654, dated May 25, 2010.

Office Action in U.S. Appl. No. 12/506,861, dated Apr. 21, 2010.

* cited by examiner

LIGHT DUTY LIQUID DETERGENT COMPOSITIONS OF SULFONATED ESTOLIDES AND OTHER DERIVATIVES OF FATTY ACIDS

RELATED APPLICATIONS

This application claims priority to international PCT Application Serial No. PCT/US09/31608 entitled, "SULFONATED ESTOLIDES AND OTHER DERIVATIVES OF FATTY ACIDS AND USES THEREOF" filed on Jan. 21, 2009, the complete matter of which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The present technology, in general, relates to sulfo-estolides. More particularly, the present technology relates to light duty liquid (LDL) detergent compositions that contain sulfo-estolides as surfactants. The sulfo-estolide surfactants include sulfo-estolide derivatives and salts of sulfo-estolides. Applications and/or processes of utilizing the presently described sulfo-estolide surfactants, in particular as a component within light duty liquid detergent compositions and/or formulations, are also disclosed.

Desirable attributes for light duty liquid detergents, in general, include the ability to emulsify, suspend or penetrate greasy or oily soils and suspend or disperse particulates, in order to clean articles or surfaces; and then prevent the soils, grease, or particulates from re-depositing on the newly cleaned articles or surfaces. It is also desirable for the light duty liquid to provide sustained foaming in dilute wash solution in the presence of the soils being cleaned. In order to optimize these attributes, it is desirable to produce LDLs that contain moderate to high levels of surfactants (e.g., greater than about 20% total surfactant) in combinations and types that would typically produce gels instead of liquids. For example, such gels were not workable, not easily dispensed or poured, at room temperature. Surprisingly, the present technology now demonstrates that the addition of at least one sulfo-estolide surfactant, having the general Formula 1 as described herein, to LDL formulations, for example, decreases the viscosity of such a formulation into a workable liquid range at room temperature. Further, the sulfo-estolide containing LDL formulations of the present technology maintain high foaming and optimized cleaning attributes.

In addition, there is the further challenge of developing environmentally friendly or "green" light duty liquid detergents as state and federal regulations are restricting the amount and use of phosphates in such detergents. The desirability of avoiding phosphates in detergents is well recognized, and phosphorus compounds have been banned from laundry detergents for many years though other detergents have been exempted from the phosphate ban on the basis that such phosphates are necessary for acceptable washing performance. Phosphorus-based compounds when released into water sources such as lakes, rivers, and bays, serve as nutrients for algae growth, resulting in deterioration of water quality. The algae blooms in lakes and ponds can suffocate plants and animals that live in those bodies of water and seriously disrupt the quality of waterways. Therefore, there has been the continuing challenge to develop and formulate "green" formulations of light duty liquid detergents that provide adequate foaming and cleaning capabilities, but with reduced or prevented negative environmental impact. The sulfo-estolide surfactants/compositions/components of the present technology and/or light duty liquid detergent formulations containing such sulfo-estolide components/surfactants of the present technology surprisingly and unpredictably provide "green" and/or "eco-friendly" compositions that are plant derived, biodegradable and while achieving adequate foaming and cleansing.

BRIEF SUMMARY OF THE INVENTION

In at least one aspect the present technology provides a liquid detergent composition, comprising about 0.1% to about 90% active weight of the total composition of at least one sulfo-estolide surfactant having the following general Formula 1:

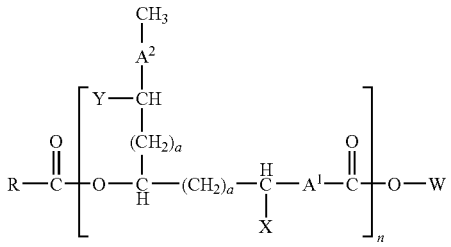

wherein n is an integer from 1-30; one of X and Y is $SO_3$—Z, the other of X and Y is H (i.e., a hydrogen atom), and X and Y are independently assigned in each repeating unit; A1 and A2 are linear or branched, saturated or unsaturated, substituted or un-substituted, alkyl diradicals wherein the total number of carbons for each repeating unit is independent and in the range of C8 to C22; a is 0, 1, or 2, and is independently assigned in each repeating unit; R is linear or branched, saturated or unsaturated, substituted or un-substituted hydrocarbon wherein the total number of carbon atoms is from 1 to 24; W is H or a monovalent or divalent metal cation, ammonium cation, substituted ammonium cation, or an alkyl or substituted alkyl group; and Z is H or a monovalent or divalent metal cation, ammonium or substituted ammonium cation. The composition further comprises about 0.1% to about 70% of at least one additional surfactant.

In another aspect the present technology provides a composition which can reduce the viscosity of a liquid detergent, wherein the composition comprises about 0.1% to about 70% by weight of at least one phase stability compound having the general Formula 1, wherein the viscosity of the liquid detergent is reduced to 100 cps to 6000 cps.

DETAILED DESCRIPTION OF THE INVENTION

The present technology, in general, relates to sulfo-estolides. More particularly, the present technology relates to light duty liquid detergent compositions that contain sulfo-estolides as surfactants. The sulfo-estolide surfactants of the present technology include, but are not limited to, sulfo-estolide derivatives and salts of sulfo-estolides. Such compositions having the general Formula 1:

Formula 1

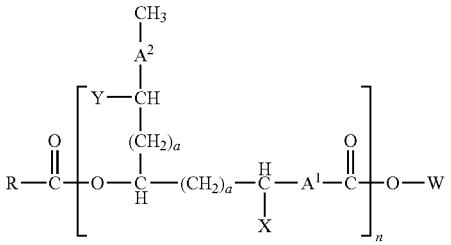

In Formula 1:

n is an integer from 1 to about 30, alternatively 1 to about 10, alternatively 1 to 4, alternatively 1, 2, or 3, alternatively 1 or 2, alternatively 1; or mixtures thereof;

one of X and Y is $SO_3^-Z$, the other of X and Y is H (i.e., a hydrogen atom), and X and Y are independently assigned in each repeating unit;

$A^1$ and $A^2$ are independently selected linear or branched, saturated or unsaturated, substituted or unsubstituted alkyl diradicals, where the total number of carbons for each repeating unit is independent and in the range of $C_8$ to $C_{22}$. As defined here, the term "alkyl diradical" is meant to refer to a linking hydrocarbon or alkylene segment, for example but by no means limited to —$(CH_2)_3$—, —$(CH_2)_4$—, —$(CH_2)_5$—, and so forth;

a is 0, 1, or 2, and is independently assigned in each repeating unit. When a=0, 1, or 2, the functional group corresponds to an alpha-sulfo-estolide, beta-sulfo-estolide, or gamma-sulfo-estolide, respectively;

R can be linear or branched, saturated or unsaturated, substituted or un-substituted hydrocarbon, wherein the total number of carbon atoms can be from 1 to about 24. In at least one embodiment, R has from about 7 to about 21 carbon atoms, alternatively from about 8 to about 16 carbon atoms, and can be a saturated or unsaturated linear or branched hydrocarbon, a linear or branched hydroxyalkane sulfonate, or a linear or branched alkene sulfonate. For example, in one embodiment, $A^1$ and $A^2$ are linear alkyl diradicals and R is saturated or unsaturated linear hydrocarbon, linear hydroxyalkane sulfonate, or linear alkene sulfonate having from about 7 carbon atoms to about 21 carbon atoms, alternatively from about 8 carbon atoms to about 16 atoms carbons;

W is a monovalent or divalent metal; ammonium; substituted ammonium; H (i.e., a hydrogen atom); or a linear or branched, substituted or unsubstituted alkyl having from 1 to about 22 carbon atoms. For example, W can be an alkali or alkaline earth metal cation. Alternatively, W can be a glycerine joined by an ester linkage, e.g., a substituted C3 alkyl such that the general Formula 1 is incorporated one or more times as an ester in a monoglyceride, a diglyceride, or a triglyceride; and Z is H (i.e., a hydrogen atom) or a monovalent or divalent metal cation, ammonium or substituted ammonium cation, preferably an alkali or alkaline earth metal cation, for example potassium, sodium, calcium, or magnesium, with potassium being preferred in certain embodiments.

The above structure is illustrative of the sulfo-estolide products of the present technology that may be derived from, for example, linear unsaturated fatty acid feedstocks. It is understood that sultone hydrolyzed products and structures of a comparable nature may be derived from branched and/or substituted unsaturated fatty acids or mixtures of linear and branched and/or substituted unsaturated fatty acids.

Additional sulfo-estolide compositions may be produced from fatty acid feedstocks comprising polyunsaturated fatty acids, where $A^1$ and $A^2$ may be independently selected from alkyl diradicals that are: a) saturated; b) unsaturated; c) unsaturated and substituted with a sulfonate group; d) substituted with a hydroxyl group and a sulfonate group; e) substituted with a ester group and a sulfonate group (i.e., a sulfo-estolide).

In another embodiment of the present technology, the sulfo-estolide compositions are comprised of carboxylic esters, or are reported in an ester analysis as carboxylic esters. Although it is contemplated that at least some of these carboxylic esters are sulfo-estolides, the presently described technology is not limited by the accuracy of this belief, for example the compositions may contain carboxylic esters wherein X and Y within one or more repeating units, in general Formula 1, are both H (i.e., a hydrogen atom).

In another embodiment of the present technology, the sulfo-estolide compositions are comprised of sulfo-estolides of the general Formula 1 and a non-sulfonated estolide which comprises, for example, two or more fatty acid chains that does not contain a sulfonate group.

Definitions

The term "sulfo-estolide" ("SE") is used herein to describe general Formula 1. The term "partially hydrolyzed sulfo-estolide" ("PHSE") describes compositions of general Formula 1 wherein the esters have been partially hydrolyzed (from between about 1% to about 95%). The term "hydrolyzed sulfo-estolide" ("HSE") describes compositions of general Formula 1 wherein the esters have been fully hydrolyzed (greater than about 95%, for example).

The term "sultone hydrolyzed product" ("SHP") is used herein to describe salts of sulfo-estolides that are produced from one or more feedstocks comprising unsaturated fatty acids by a process comprising the steps of sulfonation with $SO_3$, neutralization, and hydrolysis of sultones. The neutralization and hydrolysis are conducted at a level of caustic addition that maintains the pH in the range from about 4 to about 10.

The resulting product contains carboxylic acid esters at a level that corresponds to about 5 to about 95 mol %, alternatively about 20 mol % to about 60 mol %, alternatively about 20 mol % to about 45 mol %, alternatively about 30 mol % to about 45 mol % of the total carboxylic functionality in the composition. Although not wanting to be bound by any particular theory, it is believed that none or few of the esters (whether they are sulfo-estolides or not) are hydrolyzed in the process of making SHP. By processing at a low temperature and neutralizing the acid as it leaves the sulfonator as quickly as possible, it is further believed that lower ester levels will be obtained. Through improvement and modification of process conditions for the production of esters, it is contemplated that products of the present technology that have higher ester content will be obtained. For example, it is believed that the ester content may be obtained at lower and/or higher levels through the selection of the molar ratio of $SO_3$ to alkene functionality used in the sulfonation step, or alternatively or in addition, through the selection of the amount of monounsaturated and/or polyunsaturated fatty acids comprising the unsaturated fatty acid feedstock.

The term "ester hydrolyzed product" ("EHP") is used herein to describe one or more sulfonate compositions of the present technology that is produced from unsaturated fatty acids by sulfonation with $SO_3$ to produce sulfo-estolide and subsequent hydrolysis of greater than about 95% of the carboxylic esters. For example, the resulting product may have a carboxylic ester content that corresponds to less than about 5 mol %, alternatively less than about 2 mol %, alternatively less than 1 mol % of the total carboxylic functionality in the composition.

The term "partially ester hydrolyzed products" ("PEHP") is used herein to describe salts of sulfo-estolides of the present technology that are produced from unsaturated fatty acids by sulfonation with $SO_3$ and hydrolysis of a portion of the carboxylic esters. The molar percentage of hydrolysis of carboxylic esters that is realized is from about 1% to about 95%, alternatively from about 5% to about 90%, alternatively from about 10% to about 90%, alternatively from about 20% to about 90%.

As defined herein, the term "sulfo-estolide surfactant" is meant to refer to a variety of surfactant compositions of the present technology as described, for example, by general Formula 1. This includes, for example, surfactant compositions of SE, HSE, PHSE, SHP, EHP, and PEHP, or mixtures thereof.

As defined herein, the term "free alkalinity" is meant to refer to the total amount of carboxylate anion and hydroxide present in a composition, as may be measured by, for example, potentiometric titration of an aqueous solution with aqueous strong acid, for example HCl, to an endpoint of about pH 3 to about pH 4.5, or alternatively to bromophenol blue endpoint.

As defined herein, the term "free caustic" is meant to refer to the total amount of excess strong alkalinity present in a composition, as may be measured by, for example, potentiometric titration of an aqueous solution with aqueous strong acid, for example HCl, to an endpoint of about pH 9 to about pH 11.

A "repeating unit" means one instance of the subject matter enclosed by brackets in a formula. For example, if n=15 for a given molecule according to general Formula 1, the molecule has 15 instances of the bracketed structure. Each instance of the bracketed structure can be identical to or different from other instances of the bracketed structure. For example, the Y moiety in general Formula 1 can be H in one repeating unit and $—SO_3^-Z$ in another repeating unit of the same molecule.

Making SE or Other Carboxylic Esters

A suitable starting material for the present process of making one or more components and/or formulations of the present technology, for example, is a fatty acid (fatty carboxylic acid). Fatty acids that may be suitable for use in the present technology include, but are not limited to linear unsaturated fatty acids of about 8 to about 24 carbons, branched unsaturated fatty acids of about 8 to about 24 carbons, or mixtures thereof. Unsaturated fatty acids provided from commercial sources containing both saturated and unsaturated fatty acids are suitable for use in the practice of the present technology. Mixtures of saturated fatty acids and unsaturated fatty acids are also contemplated. In a non-limiting example, fatty acid mixtures that are rich in oleic acid (cis-9-octadecenoic acid) are suitable feedstocks. Other unsaturated fatty acids, for example but not limited to, trans-octadecenoic acids or palmitoleic acid may also be employed in the presently described technology.

Suitable feedstocks may be derived from vegetable and/or animal sources, including but not limited to fatty acids and fatty acid mixtures derived from, for example, canola oil, corn oil, cottonseed oil, linseed oil, olive oil, palm oil, peanut oil, rapeseed oil, safflower oil, sesame oil, soybean oil, sunflower oil, tall oil, tung oil, lard, poultry fat, BFT (bleachable fancy tallow), edible tallow, coconut oil, cuphea oil, yellow grease and combinations of these. Also contemplated are genetically modified or engineered oils that include, but are not limited to high oleic sunflower or soybean oil. In some embodiments, the preferred unsaturated fatty acid feedstocks may contain reduced levels of polyunsaturated fatty acids, for example, less than about 15%, alternatively less than about 10%, alternatively less than about 5% on a total weight basis. In some additional embodiments, the fatty acid feedstocks may be obtained by the partial hydrogenation of unsaturated triglycerides, for example, soybean oil followed by hydrolysis of the oil to afford fatty acids that are enriched in monounsaturated fatty acids and depleted in polyunsaturated fatty acids. The above-noted triglycerides optionally hydrogenated, can also be used as feedstocks, alone or in combination with fatty acids. Still further, in some embodiments of the presently described technology, suitable feedstocks may include those that contain appreciable amounts of saturated fatty acids, for example, up to about 80%, alternatively up to about 50%, alternatively up to about 30%, alternatively up to about 20% saturated fatty acid by weight. Alternatively, the feedstocks may be enriched in mono-unsaturated fatty acids, for example, via distillation; however, undistilled feedstocks are preferred due to lower cost.

In certain embodiments, a chain termination agent can be included in the reaction to reduce or prevent the formulation of products of general Formula 1 in which n is greater than one. The chain termination agent can be, for example, a saturated or unsaturated, substituted or unsubstituted, aliphatic or aromatic carboxylic acid having from about 7 to about 22 carbon atoms, or a combination of any two or more of these. The contemplated characteristic of a chain termination agent preferred for the present purpose is that it can form an ester. One class of preferred chain termination agents is a saturated fatty acid having from about 8 to about 22 carbon atoms, optionally from about 8 to about 14 carbon atoms, optionally about 8, about 10, or about 12 carbon atoms or mixtures of these fatty acid species.

The compounds of general Formula 1 and related compounds (for example, where n=0) can be made, for example, by: a) $SO_3$ sulfonation of a fatty acid, for example oleic acid; b) neutralization with aqueous caustic to afford a sulfonate salt solution with a pH in the range of about 4 to about 10; or c) hydrolysis of the resulting sultones, maintaining the reaction mixture at a pH of about 4 to about 10, alternatively at a pH of about 6 to about 8, alternatively at a pH of about 7. Sulfonation can be carried out, for example, using a falling film $SO_3$ process.

Alternatively, the compounds of general Formula 1 and related compounds (for example, where Z=H and W=H) can be made, for example, by falling film $SO_3$ sulfonation of a fatty acid, for example oleic acid where the process temperature of the sulfonation is sufficient, for example greater than about 20° C., to result in the formation of carboxylic esters.

Continuous $SO_3$ sulfonation processes, including those that utilize falling film reactors such as those described in Kirk-Othmer Encyclopedia of Chemical Technology, 5th ed., Vol. 23, Wiley-Interscience, Hoboken, N.J.: 2007, entry entitled "Sulfonation and Sulfation", pp. 513-562, which is hereby incorporated by reference, are suitable for conducting the sulfonation of feedstocks comprising unsaturated fatty acids in accordance with the practice of the presently described technology. For example, a monotube concentric reactor, annular film reactor, or multitube film reactor can be used to contact an unsaturated fatty acid feedstock, for example oleic acid, with a gaseous stream of $SO_3$ that is diluted with dry air. The molar ratio of $SO_3$ to alkene functionality in the fatty acid feedstock may be from about 0.3 to about 1.3, alternatively from about 0.5 to about 1.2, alternatively from about 0.8 to about 1.1, or alternatively from about 0.9 to about 1.0.

In some embodiments, a preferred ratio, for example, is less than about 0.8 so as to minimize color formation. The fatty acid feedstock is provided to the reactor at a temperature above the melting point of the feedstock, i.e. the feedstock is provided as a liquid. The sulfonation is conducted such that the reaction mass is maintained as a mobile liquid throughout the course of reaction. Preferably, a means of cooling the reaction mixture during the course of contact between the feedstock stream and the gaseous $SO_3$ stream is provided so that the sulfonic acid product is produced from the reactor at a temperature of from about 10° C. to about 80° C., alternatively from about 20° C. to about 60° C., or alternatively from about 30° C. to about 60° C.

Sulfonated unsaturated fatty acid salt and sulfonated hydroxy fatty acid salt products include, for example, those sold in Europe as Polystep® OPA by Stepan Co. (Northfield Ill.), and as Lankropol OPA and Lankropol OPA-V by Akzo Nobel (Chicago, Ill.), and in the United States as Calsoft® OS-45S by Pilot Chemical (Cincinnati, Ohio).

SE is produced from the sulfonation step and comprises carboxylic esters, provided that the reaction conditions are sufficient, for example, a high enough temperature of the acid stream, to promote carboxylic ester formation. While not limiting the scope of the presently described technology, the temperature at which carboxylic ester formation may occur is greater than about 10° C., alternatively greater than about 20° C., or alternatively greater than about 30° C. The sulfonic acid products may further comprise sulfonic acid esters, including but not limited to cyclic esters, i.e., sultones.

The process of making a sulfo-estolide mixture, including the methods of hydrolyzing sultones, hydrolyzing carboxylic esters and steps of bleaching the sulfono-estolides of the present technology is described in PCT Application Serial No. PCT/US09/31608, the complete disclosure of which is incorporated herein by reference in its entirety.

Product Descriptions

Again not wanting to be bound by any particular theory, the compositions of the present technology as described by general Formula 1, are believed to be comprised of complex mixtures of compounds that are monomeric, dimeric, and higher-order oligomeric species in terms of the number of originating fatty acid chains. The oligomerization in these mixtures is via the formation of ester linkages. Branched oligomers are also envisaged.

The sulfo-estolide functional group corresponds structurally to the condensation of the hydroxyl group of an internal hydroxy sulfonate of fatty acid with the carboxylic acid group of a second fatty acid chain, where the second fatty acid chain may be, but is not necessarily limited to: a) an unsaturated or saturated fatty acid; b) an internal hydroxy sulfonate of fatty acid; c) an internal alkene sulfonate or corresponding cyclic anhydride (i.e., sultone) of fatty acid; or d) an internal mono- or poly-sulfo-estolide of two or more fatty acids (i.e., trimer, tetramer, etc.). The position of the sulfonate group along the back bone of the fatty acid chains is dictated by the location of the double bond in the starting material (9-octadecenoic acid for example) and the "direction" in which $SO_3$ adds across the double bond (thus, 9- and 10-sulfonate positions from oleic acid).

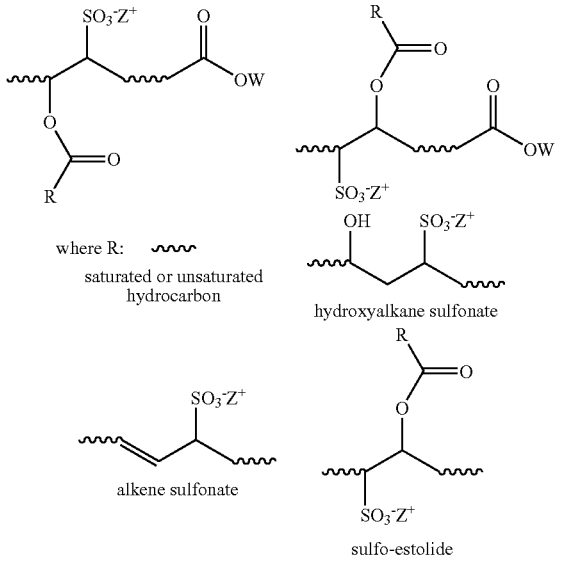

Non-ester-containing monomeric components made by this process are believed to comprise, in part, specific internal hydroxy sulfonates of fatty acid. For example, with 9-octadecenoic acid, the sulfonate groups are believed to be attached to the 9-position and alternatively the 10-position of the fatty acid. Examples are shown below.

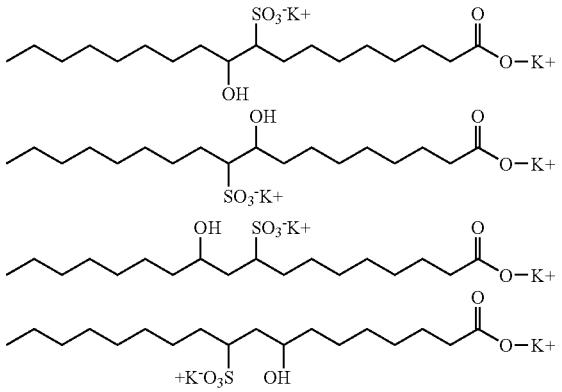

The monomeric components are further believed to comprise, in part, specific internal alkene sulfonates of fatty acid. These components may comprise cis- and/or trans-double bonds. It is also possible that compounds of the present technology are present where the unsaturation is at the position of the sulfonate group (i.e., vinylic sulfonates). Examples are shown below.

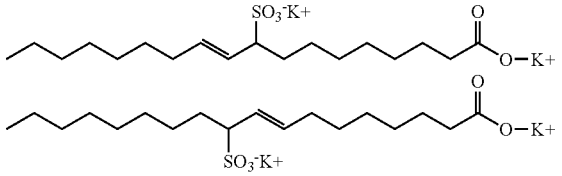

-continued

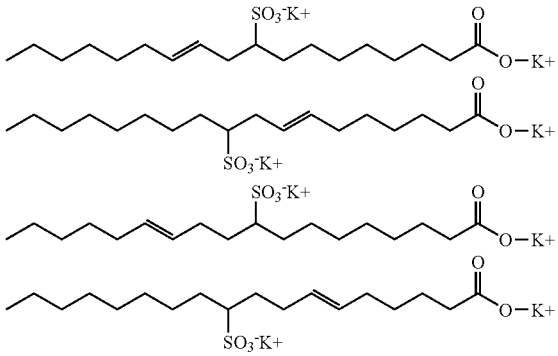

The monomeric components may further comprise disulfonated species, unsaturated fatty acids, and saturated fatty acids.

EHP is sometimes used herein as a designation for sulfonated products that have been subjected to complete hydrolysis of sulfo-estolide functionality. Such hydrolysis can be accomplished by, for example, treatment of SHP with excess base under high pH conditions (for example greater than about 11) at elevated temperatures (for example about 85° C. to about 100° C.). EHP is believed to comprise a mixture of hydroxyalkane sulfonates and alkene sulfonates of comparable structure to the monomeric components of sulfo-estolide compositions, though not necessarily in comparable ratios. Such mixtures are comparable to the compositions, for example, of sulfonated unsaturated fatty acids that are described, for example, in T. W. Sauls and W. H. C. Rueggeberg, Journal of the American Oil Chemists Society (JAOCS), Volume 33, Number 9, September, 1956, pp 383-389. It can be appreciated that partially ester hydrolyzed products (PEHP) will be comprised of elevated amounts of monomeric hydroxyalkane sulfonates and alkene sulfonates while maintaining some level of sulfo-estolide functionality.

Formulations and Applications of SE

The compositions as described in the present technology may be used in formulations including, for example, light duty liquid detergents. The formulations of the present technology can be used in all delivery processes such as, but not limited to, Ready-To-Use, dilutable, wipes, single use, etc. These formulations, in some embodiments are stable with enzymes, peroxide, hypochlorite bleach, and other bleaching agents.

The formulations of the present technology may also be included in compositions including, for example, a cleaning adjunct. Common cleaning adjuncts are identified in, for example, U.S. Pat. No. 7,326,675, col. 12, and PCT Publ. WO 99/05242 (Pages 29-56). Such cleaning adjuncts are identified as including, but not limited to bleaches, bleach activators, suds boosters, dispersant polymers (e.g., from BASF Corp. or Rohm & Haas) such as the ACUSOL 400 series based on acrylic acid, color speckles, silvercare, anti-tarnish and/or anti-corrosion agents, pigments, dyes, fillers, germicides, hydrotropes, anti-oxidants, enzyme stabilizing agents, pro-perfumes, carriers, processing aids, solvents, dye transfer inhibiting agents, brighteners, structure elasticizing agents, fabric softeners, anti-abrasion agents, and other fabric care agents, surface and skin care agents. Suitable examples of such other cleaning adjuncts and levels of use in the practice of the present technology are described, for example, in U.S. Pat. Nos. 5,576,282, 6,306,812 B1 and 6,326,348 B1 and PCT Publ. WO99/05242. All the patents identified in this paragraph are incorporated by reference for their further disclosures of adjuvants.

General Considerations for Light Duty Liquid Detergents (LDL)

Desirable attributes of the present technology include an ability of being in liquid form at room temperature; an ability to formulate in cold-mix applications; an ability to perform as good as or better than existing conventional surfactants or formulations containing such conventional surfactants with respect to foaming level and soil removal, as well as other properties as described herein.

For household, industrial and institutional cleaning products, both surfactants and solvents are important additional ingredients. Desirable attributes for such products include, for example, the ability to emulsify, suspend or penetrate greasy or oily soils and suspend or disperse particulates, in order to clean surfaces; and then prevent the soils, grease, or particulates from re-depositing on the newly cleaned surfaces; and continue to produce foam in the presence of the soils being cleaned. In order to optimize these attributes, it is desirable to produce LDLs that contain moderate to high levels of surfactants (e.g. from about 20% to about 100% surfactant, alternatively from about 25% to about 80% surfactant, alternatively from about 25% to about 70% surfactant). However, prior to the present technology, LDLs containing such high levels of surfactants were gels, not liquids, at room temperature. These gels were not workable, not easily dispensed or poured, at room temperature. Formulators would typically add solubilizing solvents like ethanol to convert the gels to liquids, but materials like this add flammability concerns and have minimal contribution to cleaning and foaming. Surprisingly, the components and formulations of the present technology demonstrate that the addition of at least one sulfo-estolide surfactant, having the general Formula 1, to LDL formulations decreases the viscosity for such formulations into the workable liquid range at room temperature (200 cps to 6000 cps). Further, the sulfo-estolide containing LDL formulations of the present technology containing one or more sulfo-estolides as described herein maintain the high foaming and optimized cleaning attributes described above, among others.

Formulations are contemplated having a viscosity of about 5 cPs to about 6000 cPs, measured at 25° C. using a Brookfield Viscometer model LV, with spindle 2, 3 or 4 at speeds ranging from about 12 rpm to about 50 rpm. LDL formulations containing at least one sulfo-estolide surfactant having the general Formula 1 of the present technology have been surprisingly found to have lower viscosity than comparable formulations lacking such surfactants. Since these compositions function as viscosity reducers, they are very useful for making the contemplated highly concentrated, (e.g. greater than about 20% surfactant active, and even beyond 40% active) LDL detergent formulations. Liquid compositions greater than 40% active would be very useful for performance and economy, but have heretofore been unattainable except for the use of large quantities of undesirable solubilizing alcohols as described above.

Various formulations of the present technology exhibit viscosities of from about 100 cps to about 10,000 cps; alternatively, from about 200 cps to about 6,000 cps, measured at 25° C. using a Brookfield Viscometer model LV, with spindle 2, 3 or 4 at speeds ranging from about 12 rpm to about 50 rpm.

It is also desirable to have the ability to control the foaming of different household, industrial and institutional products depending on the desired end-use applications. For example, for one or more light duty liquid detergents of the present technology, it is desirable to have suitable foaming ability along with a viscosity that is workable (viscosity of 200 cps to 6000 cp measured at 25° C. using a Brookfield Viscometer model LV, with spindle 2, 3 or 4 at speeds ranging from about 12 rpm to about 50 rpm) at room temperature.

It is also desirable to have the ability to produce "green" LDL formulations. Thus, the surfactants should be ultimately biodegradable, phosphate free, and non-toxic. To meet consumer perceptions and reduce the use of petrochemicals, a "green" formula may also advantageously be limited to the use of renewable hydrocarbons, such as vegetable or animal fats and oils, in the manufacture of one or more surfactant components. The presently described sulfo-estolide surfactants are derived from plant and/or animal fats and oils and thereby address this challenge.

It is also desirable for the pH of LDL detergents to be in the range in which contact with hands and skin is acceptable while maintaining adequate foaming and cleaning properties. The presently described compositions achieve this need by possessing adequate soil removal and foaming properties at or around neutral pH. Sulfo-estolide surfactant containing LDL detergents of the present technology have pH values in the range of from about 3 to about 10; alternatively, from about 4 to about 9; and preferably from about 6 to about 8.

Formulations

A wide variety of compositions can be made that include at least one sulfo-estolide surfactant or two or more sulfo-estolide surfactants, as described herein, with or without other ingredients as specified herein. Formulations are contemplated containing, for example, sulfo-estolide surfactants from between about 0.1% to about 70% by active weight; alternatively between about 0.1% to about 50% by active weight; alternatively, between about 0.1% to about 35% by active weight; alternatively, between about 1% to 30% by active weight based on the total actives ingredient weight of the composition.

The sulfo-estolide surfactants having the general Formula 1 described herein can be incorporated into, for example, various formulations and used as surfactants, emulsifiers, skin feel agents, film formers, rheological modifiers, solvents, release agents, lubrication agents, conditioners, dispersants, hydrotropes, etc. Such compositions can be used in end-use applications including, but not limited to, household and industrial and institutional cleaning products.

In alternative embodiments, sulfo-estolide surfactants having the general Formula 1 can be used to produce antimicrobial formulations. One or more sulfo-estolide based LDL antimicrobial compositions of the present technology can include from 0% to about 10% by weight of a polyvalent metal ion chelant, alternatively from about 0.1% to about 10%, alternatively from about 1% to about 10%, alternatively from about 1% to about 5% by weight, and may additionally include any range or percentage there between, including, but not limited to, for example, increments of about 0.1, 0.2, 0.3, 0.4, 0.5, 0.6, 0.7, 0.8, 0.9, 1.0. 2.5, 5% and multiplied factors thereof. Further, the antimicrobial compositions can further include from 0% to about 10% of an alkaline builder, alternatively from about 0.1% to about 10%, alternatively from about 1% to about 10%, alternatively from about 1% to about 5% by weight, and may additionally include any range or percentage there between, including, but not limited to, for example, increasing or decreasing increments of about 0.1, 0.2, 0.3, 0.4, 0.5, 0.6, 0.7, 0.8, 0.9 or 1.0% 2.5%, 5% and multiplied factors thereof such as 1.5×, 2.0×, 3.0×, 4.0×, 5.0× and 6.0× as desired to achieve higher concentrates. Suitable alkaline builders include, but are not limited to sodium carbonate, potassium pyrophosphate, sodium metasilicate, or combinations thereof. Further, such antimicrobial compositions may also include at least one additional component, for example dyes and fragrances, from 0% to about 2% by weight, alternatively from about 0.01% to about 2%, alternatively from about 0.1% to about 2%, alternatively from about 0.1% to about 1% by weight, and including any percentage or range there between, including, but not limited to for example, alternatively from about 0.1% to about 10%, alternatively from about 1% to about 10%, alternatively from about 1% to about 5% by weight, and may additionally include any range or percentage there between, including, but not limited to, for example, increasing or decreasing increments of about 0.1, 0.2, 0.3, 0.4, 0.5, 0.6, 0.7, 0.8, 0.9 or 1.0%, 2.5%, 5% and multiplied factors (1.5×, 2.0×, 3.0×, 4.0×, 5.0× and 6.0×) thereof.

LDL antimicrobial components of the present technology can also include, but are not limited to triclosan, n-alkyl dimethyl benzyl ammonium chloride, n-alkyl dimethyl benzyl ammonium chloride, dialkyl dimethyl ammonium chloride, didecyl dimethyl ammonium chloride, dioctyl dimethyl ammonium chloride, phenolics, iodophors, pine oil, methyl salicylate, morpholine, silver, copper, bromine, and quaternary ammonium compounds, derivatives thereof, and combinations thereof including, but not limited to, the polyquaternium series as is used in hand soap formulations, and 3,4,4' trichlorocarbanilide as disclosed in U.S. Pat. No. 6,605,579.

Suitable antimicrobial agents can be found in *McCutcheons'* 2009 *Functional Materials of North American Edition*, Volume 2, 2009, pages 239-246, which is incorporated by reference in its entirety. Suitable antimicrobial agents include, but are not limited to, Abiol, which is available from 3V Inc. (Brooklyn, N.Y.); Phenobact, which is available from Alzo International, Inc. (Sayreville, N.J.); Emercide 1199, which are available from Cognis Canada Corp. (Mississauga, ON); Bronidox 1160, which is available from Cognis Corporation Care Chemicals (Monheim, Germany); Custom D Urea, Custom DMDM, Custom I Urea, Custom Methyl Paraben, Custom PCMX, Custom PCMX 25%, Custom Propyl Paraben, Salicat K 727, Salicat K100, Salicat K145, Salicat MM, Saligerm G-2, Salinip, which are available from Custom Ingredients, Inc. (Chester, S.C.); Bioban BP-Pharma, Bioban BP-Plus, Bioban CS-1135, Bioban CS-1246, Bioban P-1487, Dowicil 75, Dowicil 200, Dowicil QK-20, Fuelsaver, Oxaban-A (78%), Oxaban-A (90%), Tris Nitro concentrate, Ucarcide, which are available from Dow Chemical Company (Wilmington, Del.) Generic Propylene glycol, which is available from Huntsman Corporation Performance Products (The Woodlands, Tex.); Bronopol, Lexgard 688, Lexgard 690, Lexgard B, Lexgard GMC, Lexgard GMCY, Lexgard M, Lexgard MCA, Lexgard O, Lexgard P, Myacide SP, which are available from Inolex Chemical Co. Personal Care Application Group (Philadelphia, Pa.); Anthium Dioxide, which is available from International Dioxide, Inc. (North Kingstown, R.I.); Germaben II, II-E, Germall II, Germall 115, Germall Plus, LiquaPar Oil, LiquaPar Optima, LiquaPar PE, Liquid Germall Plus, Methyl Paraben, Propyl Paraben, Suttocide A, which are available from International Specialty Products/ISP (Wayne, N.J.); Liposerve DU, Liposerve DUP, Liposerve IU, Liposerve MM, Liposerve PP, which are available from Lipo Chemicals, Inc. (Paterson, N.J.); Dantogard, Dantogard 2000, Dantogard Plus, Dantogard Plus Liquid, Dantogard XL-1000, Dantoserve MS, Dantoserve SG, Geogard 111 A, Geogard 111 S, Geogard 221, Geogard 233 S, Geogard 234 S, Geogard 361, Geogard Ultra, Glycacil, Glycacil 2000, Glycacil SG, Glydant, Glydant 2000, Glydant Plus, Glydant Plus Liquid, Glydant XL-1000, which are available from Lonza Inc. (Allendale, N.J.); Mackstat 2G, Mackstat OM, Mackstat SHG, Paragon, Paragon II, Paragon III, Paragon MEPB, Phenagon PDI, which are available from The McIntyre Group (Norwalk, Conn.); Merguard 1105, Merguard 1190, Merguard 1200, which are available from Nalco Company (Naperville, Ill.); Britesorb A 100, which is available from The PQ Corp (Malvern, Pa.); Generic Methylparaben NF, Generic Propylparaben NF, Generic Ethylparaben NF, Generic Butylparaben NF, which are available from RITA Corp. (Crystal Lake, Ill.); Kathon CG, Kathon CG II, Kathon CG/ICP, Kathon CG/ICP II, Kathon LX 1.5% Microbicide, Koralone B-119 Preservative, Koralone N-105, Kordek MLX, Lanodant DM, Neolone 950, Neolone CapG, Neolone DsP, Neolone M-10, Neolone MxP Preservative, Neolone PE Preservative, Rocima 550 Microbicide, Rocima 586, Rocima 607/Microbicide, Rocima BT 2S, Rocima BT NV 2, which are available from Rohm and Haas Co./Consumer and Industrial Specialties (Philadelphia, Pa.); Vancide TH, which is available from R.T. Vanderbilt Co. Inc. (Norwalk, Conn.); PCMC, which is available from R.W. Greeff and Co., Inc./Howard Hall Div. (Stamford, Conn.); Sepicide HB, which is available from Seppic Inc. (Fairfield, N.J.); Onamer M, Onyxide 200 Preservative, Stepanquat 50NF, Stepanquat 65NF, Stepanquat 200, Stepanquat 1010, Stepanquat 1010-80%, Stepanquat 1210-80%, which are available from Stepan Company (Northfield, Ill.); Grotan, Mergal 142, Mergal 174, Mergal 186, Mergal 192, Mergal 198, Mergal 364, Mergal 395, Mergal 586, Mergal 1000, Mergal K9N, Mergal K10N, Mergal K14, Mergal 1005, which are available from Troy Corporation (Florham Park, N.J.), among others.

Optionally, the LDL detergent compositions of the present technology can include at least one additive as well. Suitable additives include, but are not limited to viscosity modifiers, electrolytes, thickeners, emollients, skin conditioning agents, emulsifier/suspending agents, solubilizing agents, fragrances, colors, dyes, herbal extracts, vitamins, builders, enzymes, pH adjusters, preservatives, antimicrobial agents, polymers, magnesium sulfate, derivatives thereof, combinations thereof, and other ingredients commonly known in the art as an additive.

Magnesium sulfate, builders, solubilizing agents and enzymes may be added to aid in cleansing ability, for example. Emollients (including, without limitation, vegetable oils, mineral oils, silicone oils, petrolatum, polyglycerol methyl esters, and esters), skin conditioning agents (such as glycerine and free fatty acid), vitamins and herbal extracts may be added to further improve conditioning performance. Fragrances, dyes, opacifying agents, and pearlescent agents may also be added to further enhance the appearance and smell of one or more of the finished LDL formulations of the present technology.

Suitable preservatives for use in the practice of the present technology include, but are not limited to acidics and phenolics, for example, benzoic acid and salts, sorbic acid and salts, propionic acid and salts, boric acid and salts, dehydroacetic acid, sulfurous and vanillic acids, Ottasept® (which is available from Ottawa Chemical Company (Toledo, Ohio)), Irgasan DP 300® (which is available from Geigy Chemical Corporation (Ardsley, N.Y.)), phenol, cresol, chlorocresol, o-phenylphenol, chlorothymol, parabens, alkyl esters of parahydroxybenzoic acid, methyl, ethyl, propyl, benzyl, and butyl-p-hydroxybenzoates; mecurials, for example, thiomersal, phenylmercuric acetate and nitrate, nitromersol, sodium ethylmercurithiosalicylate; quaternary ammonium compounds, for example, benzalkonium chloride, cetylpyridinium chloride, benzethonium chloride, cetyltrimethyl ammonium bromide, Polyquad® (which is available from Alcon Research, Ltd. (Forth Worth, Tex.)); and other compounds, for example, methylchloroisothiazolinone, methylisothiazolinone, 2-methyl-4-isothiazolin-3-one, 1,2-benzisothiazolin-3-one, imidazolidinyl urea, 1,3-Dimethylol-5,5-dimethylhydantoin, alcohols (ethyl alcohol), chlorobutanol, phenoxy-2-ethanol, benzyl alcohol, phenylethyl alcohol, chlorhexidine, polyaminopropyl biguanide, chloroform, 6-Acetoxy-2,4-dimethyl-m-dioxane 2,4,4' trichloro-2'-hydroxy-diphenylether, imidizolidinyl urea compound, bromo-2-nitropropanediol-1,3-bromo-5-nitrol-1,3 dioxane 2-methyl-4-isothiazoclin-3-one and 5 chloro derivative, 1-(3-Chloroallyl)-3,5,7-triazo 1-azoniaadamantane chloride (Dowicil 200)® (which is available from Dow Chemical Company (Midland, Mich.)), Bronopol® (which is available from Boots Company Limited (Nottingham, England)), Ucarcide® (which is available from Union Carbide Corporation (Danbury, Conn.)), Germal II®, Germal 115® (which are available from Produits Sanitaires Unique Inc. (La Pocatiere, QC), Glydant® (which is available from Lonza, Inc. (Fairlawn, N.J.)), Mycide SP®, Kanthon CG®, Oxadine A®, Omadine® (which is available from Olin Corporation (New Haven, Conn.)), Phenoxetol® (which is available from Nipa Laboratories, Ltd. (Manchester, England)). Suitable preservatives for personal care products can be found in *Preservatives for Cosmetics Manual*, Second Edition, by David S. Steinbens, 2006, which is incorporated by reference in its entirety.

Enzymes suitable for use in the practice of the present technology include proteases, amylases, and lipases.

Polymers suitable for use in the practice of the present technology include, for example, anionic polymers, acrylates, hydroxyethylcelluloses, zwitterionic polymers, gelatins, xanthan gums, polysaccharides, and polyethylene glycols.

Sulfo-estolide surfactant containing LDL detergents of the present technology that comprise from about 1% to about 99% of at least one carrier are also contemplated. As will be appreciated by at least those skilled in the art, a variety of carriers, vehicles, diluents, and the like are suitable for use in the practice of the present technology. Thus, it will also be appreciated that the terms "carrier", "vehicle", and "diluent" are to be considered non-exhaustive and interchangeable with respect to the present technology and in describing the various formulations, applications, compositions, et cetera thereof.

The sulfo-estolide containing LDL detergent compositions described herein are preferably in the form of non-emulsion liquids in which water is the principal carrier. Alternatively, although less preferred, other solvents such as alcohols may be utilized in combination with water. The level of water in a liquid cleaning composition is preferably from about 10% to about 99% by weight, alternatively from about 20% to about 50% by weight. Solvents that may be practiced in connection or conjunction with the present technology include, but are not limited to, 1,3-propanediol, propylene glycol, glycerol, ethanol, glycol ethers, derivatives thereof, combinations thereof, and others.

Additional Surfactants and Foam Stabilizing Surfactants

The compositions of the present technology can contain additional surfactants and foam stabilizing surfactants, which can be anionic, cationic, nonionic, ampholytic (includes usage of the term amphoteric), amphoteric, zwitterionic, in nature or combinations thereof. Suitable co-surfactants for use in light duty liquid detergents are described, for example, in U.S. Application Serial No. PCT/US09/31608, the disclosure of which is hereby incorporated by reference.

Certain embodiments of the present technology contain additional surfactants in the amounts of from about 2% to about 70% by active weight; alternatively, from about 5% to about 45% by active weight; alternatively, from about 10% to about 30% by active weight based on the total actives ingredient weight of the composition.

Preferred additional surfactants of the present technology include, for example, Steol CS-270 (lauryl 2-mole average ether sulfonate), Steol CS-170 (lauryl 1-mole average ether sulfonate), Steol CS-330 (lauryl 3-mole average ether sulfonate), Bio-Soft EC-690 (alcohol ethoxylate), Bio-Soft D-40 (sodium alkylbenzenesulfonate), Bio-Soft S-101 (alkylbenzene sulfonic acid) neutralized with sodium, potassium, ammonium and/or magnesium, Bio-Terge AS-40 (sodium olefin sulfonate), and/or Stepanol WA-Extra K (sodium lauryl sulfate), all from the Stepan Company, Northfield Ill. Any of the aforementioned anionic surfactants may be neutralized to form the sodium, potassium, ammonium or magnesium salts.

Certain embodiments of the present technology can contain foam stabilizing surfactants in amounts of from about 0.5% to about 15% by active weight; alternatively, from about 3% to about 10% by active weight; alternatively about 5% by active weight based on the total actives ingredient weight of the composition.

Preferred foam stabilizing surfactants of the present technology can include Amphosol CA (cocoamidopropyl betaine), Ammonyx LMDO (lauryl myristal amidopropyl dimethyl amine oxide), Ammonyx LO (lauryl dimethyl amine oxide) all from the Stepan Company, Northfield Ill., as well as Glucopon 600 (alkyl polyglucoside), and Glucopon 425 N (alkyl polyglucoside), both from the Cognis Company, Monheim Germany.

Anionic Surfactants

"Anionic surfactants" are defined here as amphiphilic molecules with an average molecular weight of less than about 10,000, comprising one or more functional groups that exhibit a net anionic charge when in aqueous solution at the normal wash pH, which can be a pH between about 5 to about 11. The anionic surfactant used in the present technology can be any anionic surfactant that is substantially water soluble. "Water soluble" surfactants are, unless otherwise noted, include surfactants which are soluble or dispersible to at least the extent of 0.01% by weight in distilled water at 25° C.

Another important class of anionic compounds is the water soluble salts, particularly the alkali metal salts, of organic sulfur reaction products having in their molecular structure an alkyl radical containing from about 6 to about 24 carbon atoms and a radical selected from the group consisting of sulfonic and sulfuric acid ester radicals.

Additional anionic surfactants of the present technology include, but are not limited to, sulfoacetates, olefin sulfonates, alkyl benzene sulfonates, alkyl sulfosuccinates, alkyl sulfomethylsuccinates, derivatives thereof, combinations thereof, among others.

Cationic Surfactants

Cationic surfactants contemplated for use in the present technology include, for example, ditallow dimethylammonium chloride (DTDMAC), fatty alkanolamides (FAA), and quaternized diesters of trialkanolamines and fatty acids. The proportions of cationic surfactants used in one or more a formulations of the present technology can range, for example, from about 0.1% to about 20%, more preferably between about 1% to about 10%, even more preferably between 1% to about 5%. See also P&G U.S. Pat. No. 5,929,022; column 6, 2nd paragraph through column 7, 1st paragraph.

Nonionic Surfactants

Examples of suitable nonionic surfactants for use in the practice of the present technology include alkyl polyglucosides ("APGs"), alcohol ethoxylates, nonylphenol ethoxylates, among others. The nonionic surfactant may be used in an amount of from about 1% to about 90%, more preferably from about 1% to about 40% and most preferably between about 1% to about 32% of an LDL detergent formulation of the present technology. Other suitable nonionic surfactants are described in P&G U.S. Pat. No. 5,929,022; column 4, 2nd paragraph through column 6, end of 1$^{st}$ paragraph, which is incorporated herein by reference in its entirety.

Preferred additional nonionic surfactants and foam stabilizing nonionic surfactants of the present technology include, but are not limited to alcohol ethoxylates, alkyl polyglucosides, alkyl ethanolamides, and alkyl esters.

Ampholytic Surfactants

Ampholytic (includes usage of the term amphoteric) synthetic detergents can be broadly described as derivatives of aliphatic or aliphatic derivatives of heterocyclic secondary and tertiary amines, in which the aliphatic radical may be straight chain or branched and where one of the aliphatic substituents contains from about 8 to about 18 carbon atoms and at least one contains an anionic water-solubilizing group, e.g., carboxy, sulfo, sulfato, phosphato, or phosphono (see U.S. Pat. No. 3,664,961, which provides specific examples of ampholytic surfactants from col. 6, line 60, to col. 7, line 53, incorporated here by reference). Examples of suitable ampholytic surfactants include, for example, fatty amine oxides and fatty amidopropylamine oxides. At least one suitable example is cocoamidopropyl betaine (CAPB) also known as coco betaine. Ampholytic surfactants can be used at, for example, a level from about 1% to about 50%, more preferably from about 1% to about 10%, even more preferably between about 1% to about 5% of the formulation, by actives weight percent.

Some preferred foam stabilizing ampholytic surfactants for use in the practice of the present technology can include, but are not limited to amine oxides, amidopropyl amine oxides, betaines, amidopropyl betaines, sulfobetaines, hydroxysultaines, amphoacetates, amphopropionates, alkyl amines, organic diamines, derivatives thereof, or combinations thereof, among others.

Zwitterionic Surfactants

Suitable zwitterionic synthetic surfactants for use in the practice of the present technology can be broadly described as derivatives of aliphatic quaternary ammonium and phosphonium or tertiary sulfonium compounds, in which the cationic atom may be part of a heterocyclic ring, and in which the aliphatic radical may be straight chain or branched, and where one of the aliphatic substituents contains from about 3 to 18 carbon atoms, and at least one aliphatic substituent contains an anionic water-solubilizing group, e.g., carboxy, sulfo, sulfato, phosphato, or phosphono. (see e.g., U.S. Pat. No. 3,664,961, which provides various examples of zwitterionic surfactants from col. 7, line 65, to col. 8, line 75, incorporated here by reference). Zwitterionic surfactants can be used in various formulations of the present technology from about 1% to about 50%, more preferably from about 1% to about 10%, even more preferably from about 1% to about 5% by actives weight percent of the present formulations.

Mixtures of Surfactants

Mixtures of any two or more individually contemplated surfactants, whether of the same type or different types, are envisaged.

Builders

In some embodiments, the LDL detergent formulations containing sulfo-estolide surfactants of the present technology include at least one builder. Preferably, suitable phosphate-free builders known in the art are used. Builders included compositions comprising a mixture of sodium carbonate and/or sodium citrate and low molecular weight polyacrylic polymer, such as a polyacrylate organic and/or inorganic detergent builders, and the like. Other builder salts for use in the practice of the present technology including, but not limited to gluconates, phosphonates, nitriloacetic acid salts, combinations thereof, and derivatives thereof can be mixed with, for example, sodium bicarbonate and/or sodium citrate. Additional embodiments of the present technology are practiced with citric acid and/or citrate salt of a metal ion as the builder.

EXAMPLES

The compositions and processes described here, and ways to make and use them are illustrated by the following examples. Examples stated in the present or future tense are not represented as having been carried out. Examples to the methods of producing and testing sulfo-estolides of the present technology are incorporated by reference in their entirety from PCT Application Serial No. PCT/US09/31608 filed on Jan. 21, 2009, Examples 1-26.

Example 1

Comparison of Surface Activites

The surface activities of SE were compared with other commonly used anionic surfactants, STEOL® CS-230 (Sodium Laureth Sulfate, 2EO), STEOL® CS-330 (Sodium Laureth Sulfate, 3EO), STEPANOL® WA-WXTRA (Sodium Lauryl Sulfate), all available from Stepan Company, Northfield, Ill. The surface activity was measured using Kruss K12 tensiometer at 25° C. in DI water. The results can be found in Table 1. The critical micelle concentration (CMC) and the surface tension at CMC are important properties for a surfactant. CMC indicates the minimum concentration of a surfactant that forms aggregates. The surfactant with lower CMC is more effective to emulsify or remove oil. The surface tension indicates how efficient a surfactant can reduce the surface energy of water. Lower surface tension is favorable for wetting and cleansing. The results showed that SE is an effective surfactant.

TABLE 1

| | CMC (mg/L) | Surface Tension @CMC (mN/m) |
|---|---|---|
| SE | 36.1 | 34.5 |
| STEPANOL WA-EXTRA (SLS) | 184.8 | 26.3 |
| STEOL CS-230 (SLES-2) | 171 | 25 |
| STEOL CS-330 (SLES-3) | 75 | 30 |

Example 2

Light Duty Liquid Detergent Composition of the Present Technology

Table 2 presents light duty liquid laundry detergent formulas. Formula B includes a sulfonated-estolide surfactant (SE) of the present technology while Formula A does not. SE is a sulfonated estolide potassium salt produced from 100% Oleic acid feed stock. The SE product was the result of neutralization, hydrolysis, and bleaching (using 1.1% by weight of 50% H2O2 per acid flow). The final product consisted of 71.37% solids at a pH of 5.02 with a % K2SO4 of 2.41. The formulations also included sodium lauryl sulfate (STEPANOL WA-EXTRA K, available from Stepan Company, Northfield Ill.), cocoamidopropyl betaine (Amphosol CA, also available from Stepan Company) and deionized water.

The feedstock used in this example had an equivalent weight of about 275.06 and was comprised of about 78% C-18:1, about 12% C-18:2, and about 9% saturated fatty acids. The feedstock was sulfonated on a falling film reactor at a rate of about 129.3 lbs per hour using a molar ratio of $SO_3$ to alkene functionality of about 0.95. The SE sulfonic acid was continuously neutralized in a loop reactor with concurrent addition of about 49.1 lbs per hour of 45% aqueous KOH and about 37.9 lbs per hour of water. The temperature of the reaction mixture in the loop reactor was about 80° C. Neutralized SE solution was continuously fed from the loop reactor to an in-line mixer, where about 2.61 lbs per hour of 50% aqueous hydrogen peroxide was homogenized into the solution, which was about pH 5.8. This reaction mixture was then fed to a stirred tank reactor. After collecting about 60 gallons of reaction mixture, concurrent sultone hydrolysis and bleaching were continued at about 80° C. for about 4 additional hours. At the end of this 4 hour hydrolysis and bleaching period about 16.5 lbs of 38% sodium bisulfite solution was added to the reaction mixture to reduce the residual peroxide in solution from about 0.25% (wt/wt) active peroxide down to about 0.02% (wt/wt) active peroxide. The SHP produced from this reaction was at a pH of about 5.0, was comprised of about 69.8% solids and about 0.017% (wt/wt) active peroxide, and had a Klett color at 1 percent solids concentration of 51. The EHP was analyzed by titration with aqueous HCl and was found to comprise about 40.8 mol percent of the carboxylic ester.

For each component, "% Active RM" indicates the percents of active material in the feedstock, "Formula % Active" indicates the weight percent of the active material in the liquid detergent formulation, and "Wt. Needed" and "Wt. Added" (both in grams) indicate the calculated and actually weighed amounts added to a formulation having a total weight of 100.00 grams. Each of these formulations are intended to be liquid detergent formulas and it is contemplated that additional optional components may be added.

TABLE 2

| Component | Lot # | order | % Active RM | Formula % Active | Wt. Needed (gms) | Wt. Added |
|---|---|---|---|---|---|---|
| Formula A No SE | | | | | | |
| DI Water | NA | 1 | 100.00 | — | 17.06 | 17.08 |
| SE | NA | 2 | 68.00 | 0.00 | 0.00 | 0.00 |
| Stepanol WA-Extra K | 7297969 | 3 | 30.00 | 20.00 | 66.67 | 66.68 |
| Amphosol CA | 7036625 | 4 | 30.73 | 5.00 | 16.27 | 16.23 |
| | | | | Total | 100.00 | |
| Formula B With SE | | | | | | |
| DI Water | NA | 1 | 100.00 | — | 9.71 | 9.68 |
| SE | NA | 2 | 68.00 | 5.00 | 7.35 | 7.39 |
| Stepanol WA-Extra K | 7297969 | 3 | 30.00 | 20.00 | 66.67 | 66.65 |
| Amphosol CA | 7036625 | 4 | 30.73 | 5.00 | 16.27 | 16.28 |
| | | | | Total | 100.00 | |

The viscosity of the present formulations was measured by as measured at a temperature of 25° C. with a Brookfield model RVT viscometer, with spindle #3 at 20 rpm. The viscosity of the Formula A without SE was 29,440 cps and was a clear viscous gel. The viscosity of Formula B containing SE was 6,425 cps and was a viscous clear liquid. Thus, addition of the SE of the present technology provides a 4-fold decrease in the viscosity of the formulation, allowing a previously unusable gel formulation to be usable as a pourable light duty liquid detergent.

The ability of the formulations (A and B) to foam was tested using a foam mileage procedure using Crisco vegetable shortening. For comparison, a commercially available light duty liquid detergent (Ultra Palmolive) was also tested. A 0.1% solution of the LDL is prepared in 500 grams total using 140 ppm hardness tap water initially at 50 degrees Centigrade. This wash bath is agitated with a KitchenAid mixer at a setting of 6, producing copious initial foam. Crisco shortening, which serves as the soil in this procedure, is titrated into the wash solution at a rate of no more than 0.5 grams per minute with a syringe. As the soil is introduced, the foam eventually collapses. The amount of Crisco tolerated prior to foam collapse is the foam mileage for the formula. This simulates soil being introduced form the washing of dirty plates, and measures how many plates could be washed before the foam is gone. The results of the foam mileage test are shown in Table 3, wherein the addition of the SE increases the foam mileage of the formulation.

TABLE 3

| Product | % Solution | Rep | Run # | Wt (start) | Wt (end) | Soil wt | Average |
|---|---|---|---|---|---|---|---|
| Formula A | 0.1000 | 1 | 3 | 12.23 | 9.81 | 2.42 | 2.35 |
| | | 2 | 4 | 17.80 | 15.53 | 2.27 | |
| Formula B | 0.1000 | 1 | 1 | 17.81 | 14.98 | 2.83 | 2.79 |
| | | 2 | 2 | 14.98 | 12.23 | 2.75 | |
| Ultra Palmolive | 0.1000 | 1 | 5 | 15.53 | 12.32 | 3.21 | 3.15 |
| | | 2 | 6 | 12.32 | 9.24 | 3.08 | |

Example 3

Exemplary Formulations of Light Duty Liquid Detergents that Contain Sulfo-Estlide Surfactants Table 4, 5 and 6 provide exemplary formulations of liquid light duty detergents. These formulations provide pourable liquid formulations of light duty detergents.

TABLE 4

Formulation 1
High Active LDL Concentrate - "Ultra Ultra"

| Ingredient | Function | Wt as is | Raw Actives % | Formula Active % |
|---|---|---|---|---|
| Steol CS-270 | Primary | 41.18 | 68 | 28.0 |
| SE | Co-Primary | 41.18 | 68 | 28.0 |
| Ammonyx LMDO | Secondary | 17.64 | 33 | 5.8 |
| | Total | 100 | | 61.8 |

This composition contains about double the "typical" level of surfactant actives, yet is a flowable viscous liquid In Formulation 1, Stepanol WA-Extra, other olefin sulfonate, or alkyl benzene sulfonate may be used as the primary surfactant. Further, Ammonyx LO, betaine or sulfobetaine or other amine oxide or amidopropyl amine oxide, or alkanolamide may be used as a secondary surfactant.

TABLE 5

Formulation 2
High Active LDL Concentrate - "Ultra Ultra"

| Ingredient | Function | Wt as is | Raw Actives % | Formula Active % |
|---|---|---|---|---|
| Steol CS-270 | Primary | 41.18 | 68 | 28.0 |
| SE | Co-Primary | 41.18 | 68 | 28.0 |
| Ammonyx LO | Secondary | 9.84 | 30 | 3.0 |
| Glucopon 600 | Secondary | 7.8 | 55 | 4.3 |
| | Total | 100 | | 63.2 |

This composition contains about double the level of "typical" surfactant actives, yet is a flowable viscous liquid In Formulation 2, Stepanol WA-Extra, other olefin sulfonate, or alkyl benzene sulfonate may be used as the primary surfactant. Further, Ammonyx LMDO, betaine or sulfobetaine or other amine oxide or amidopropyl amine oxide, or alkanolamide may be used as a secondary surfactant. Also, any other Glucopon may be substituted for the Glucopon 600 secondary surfactant.

TABLE 6

Formulation 3
High Active LDL Concentrate - "Ultra Ultra" Antimicrobial

| Ingredient | Function | Wt as is | Raw Actives % | Formula Active % |
|---|---|---|---|---|
| Bio-Soft EC-690 | Primary | 60 | 90 | 54.0 |
| SE | Co-Primary | 20 | 68 | 13.6 |
| Ammonyx LMDO | Secondary | 9.7 | 30 | 2.9 |
| Glucopon 425 N | Secondary | 10 | 55 | 5.5 |
| Triclosan | Antimicrobial | 0.3 | 100 | 0.3 |
| | Total | 100 | | 76.3 |

This composition contains about triple the "typical" level of surfactant actives, yet is a flowable liquid Table 6 demonstrates exemplar formulations of an antimicrobial formulation of the present technology.

In Formulation 3, a blended primary nonionic surfactant or Glucopon may be substituted for Bio-Soft EC-690 in the primary/secondary surfactant system. Further, Ammonyx LO, betaine or sulfobetaine or other amine oxide or amidopropyl amine oxide, or alkanolamide may be used as a secondary surfactant. Also, any other Glucopon may be substituted for the Glucopon 425N secondary surfactant.

Example 4

Exemplar Formulations

The following prophetic formulas, in Table 7, are intended to cover light duty liquid detergents. These formulations are not intended to be limiting in any way—optional ingredients described herein regarding the present technology can be added in the proportions described. In each case, these are intended to be liquid detergent formulas and, after the addition of optional ingredients, water or another suitable carrier/vehicle/diluent will be used to bring the total weight up to 100%. All components in the following examples are Active % of the total composition:

TABLE 7

| Ingredient | Ex. A | Ex. B | Ex. C | Ex. D | Ex. E | Ex. F |
|---|---|---|---|---|---|---|
| SE | 3 | 10 | 15 | 5 | 10 | 2 |
| Primary surfactant | 10 | 30 | — | 12 | 15 | 10 |
| co-primary surfactant | 5 | — | — | 3 | 5 | — |
| secondary surfactant | 4 | 8 | 15 | 5 | 5 | 5 |
| Nonionic surfactant | — | — | 30 | 5 | 5 | 5 |
| Solubilizing Solvent | — | 1 | — | — | 5 | 2 |
| antimicrobial agent | — | — | 0.3 | — | — | — |
| preservative | 0.05 | 0.10 | 0.10 | 0.05 | 0.10 | 0.05 |
| Colorant | 0.01 | 0.005 | 0.02 | 0.01 | 0.02 | 0.015 |
| Fragrance | 0.4 | 1.0 | 1.5 | 0.5 | 1.0 | 0.6 |

Formulation levels specified can be understood to vary across a range to produce viscosities from about 200 cp to about 6000 cp, with the formulator deciding based on how the product is to be packaged and dispensed.

The embodiments and examples described here are illustrative, and do not limit the presently described technology in any way. The scope of the present technology described in this specification is the full scope defined or implied by the claims. Additionally, any references noted in the detailed description section of the instant application are hereby incorporated by reference in their entireties, unless otherwise noted.

What is claimed is:

1. A liquid detergent composition, comprising:

about 0.1% to about 99.9% active weight of the total composition of at least one sulfo-estolide surfactant having the following general Formula 1:

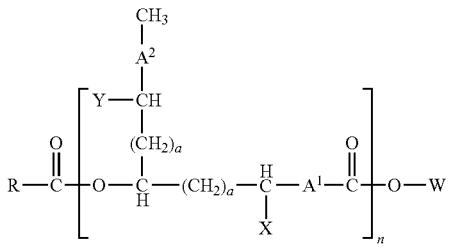

wherein n is an integer from 1-30;

one of X and Y is $SO_3$—Z, the other of X and Y is H (i.e., a hydrogen atom), and X and Y are independently assigned in each repeating unit;

$A^1$ and $A^2$ are linear or branched, saturated or unsaturated, substituted or un-substituted, alkyl diradicals wherein the total number of carbons for each repeating unit is independent and in the range of $C_8$ to $C_{22}$;

a is 0, 1, or 2, and is independently assigned in each repeating unit;

R is linear or branched, saturated or unsaturated, substituted or un-substituted hydrocarbon wherein the total number of carbon atoms is from 1 to 24;

W is H or a monovalent or divalent metal cation, ammonium cation, substituted ammonium cation, or an alkyl or substituted alkyl group; and Z is H or a monovalent or divalent metal cation, ammonium or substituted ammonium cation; and about 0.1% to about 99.9% of at least one additional surfactant.

2. The liquid detergent composition of claim 1, wherein the composition further comprises 0% to about 40% active weight of the total composition of at least one foam stabilizing surfactant.

3. The liquid detergent composition of claim 2, wherein the at least one foam stabilizing surfactant is about 0.5% to about 15% by active weight of the composition.

4. The liquid detergent composition of claim 3, wherein the at least one foam stabilizing surfactant is about 3% to about 10% by active weight of the composition.

5. The liquid detergent composition of claim 4, wherein the at least one foam stabilizing surfactant is about 5% by active weight of the composition.

6. The liquid detergent composition of claim 2, wherein the at least one foam stabilizing surfactant is a member selected from the group consisting of at least one ampholytic or amphoteric surfactant, at least one nonionic surfactant, derivatives thereof, and combinations thereof.

7. The liquid detergent composition of claim 6, wherein the at least one ampholytic or amphoteric surfactant is a member selected from the group consisting of amine oxides, amidopropyl amine oxides, betaines, amidopropyl betaines, sulfobetaines, hydroxysultaines, amphoacetates, amphopropionates, alkyl amines, organic diamines, derivatives thereof, and combinations thereof.

8. The liquid detergent composition of claim 6, wherein the at least one nonionic surfactant is a member selected from the group consisting of alcohol ethoxylates, alkyl polyglucosides, alkyl ethanolamides, alkyl esters, derivatives thereof, and combinations thereof.

9. The liquid detergent composition of claim 2, wherein the at least one foam stabilizing surfactant is a member selected from the group consisting of cocoamidopropyl betaine, lauryl myristal amidopropyl dimethyl amine oxide, lauryl dimethyl amine oxide, alkyl polyglucoside, and alkyl polyglucoside, derivatives thereof, and combinations thereof.

10. The liquid detergent composition of claim 1, wherein the composition further comprises about 1% to about 99% of at least one carrier.

11. The liquid detergent composition of claim 1, wherein the at least one sulfo-estolide surfactant having the general Formula 1 is about 0.1% to about 50% active weight of the total composition.

12. The liquid detergent composition of claim 11, wherein the at least one sulfo-estolide surfactant having the general Formula 1 is about 0.1% to about 30% active weight of the total composition.

13. The liquid detergent composition of claim 12, wherein the at least one sulfo-estolide surfactant having the general Formula 1 is about 0.1% to about 10% active weight of the total composition.

14. The liquid detergent composition of claim 13, wherein the at least one sulfo-estolide surfactant having the general Formula 1 is about 1% to about 10% active weight of the total composition.

15. The liquid detergent composition of claim 1, wherein the composition is non-toxic, biodegradable, and substantially free of phosphates.

16. The liquid detergent composition of claim 1, wherein the at least one additional surfactant is about 2% to about 70% active weight of the total composition.

17. The liquid detergent composition of claim 16, wherein the at least one additional surfactant is about 5% to about 45% active weight of the total composition.

18. The liquid detergent composition of claim 17, wherein the at least one additional surfactant is about 10% to about 30% active weight of the total composition.

19. The liquid detergent composition of claim 1, wherein the at least one additional surfactant is a member selected from the group consisting of at least one anionic surfactant, at least one nonionic surfactant, derivatives thereof, and combinations thereof.

20. The liquid detergent composition of claim 19, wherein the at least one anionic surfactant is a member selected from the group consisting of sulfoacetates, olefin sulfonates, alkyl benzene sulfonates, alkyl sulfosuccinates, alkyl sulfomethylsuccinates, derivatives thereof, and combinations thereof.

21. The liquid detergent composition of claim 19, wherein the at least one nonionic surfactant is a member selected from the group consisting of alcohol ethoxylates, alkyl polyglucosides, alkyl ethanolamides, alkyl esters, derivatives thereof, and combinations thereof.

22. The liquid detergent composition of claim 1, wherein the at least one additional surfactant is a member selected from the group consisting of lauryl 2-mole average ether sulfonate, lauryl 1-mole average ether sulfonate, lauryl 3-mole average ether sulfonate, alcohol ethoxylate, sodium alkylbenzenesulfonate, alkylbenzene sulfonic acid neutralized with sodium, potassium, ammonium and/or magnesium, sodium olefin sulfonate, and/or sodium lauryl sulfate.

23. The liquid detergent composition of claim 1, wherein the viscosity of the composition is from about 100 cps to about 10,000 cps.

24. The liquid detergent composition of claim 23, wherein the viscosity of the composition is from about 200 cps to about 6,000 cps.

25. The liquid detergent composition of claim 1, wherein pH of the composition is from about 3 to about 10.

26. The liquid detergent composition of claim 25, wherein pH of the composition is from about 4 to about 9.

27. The liquid detergent composition of claim 26, wherein pH of the composition is from about 6 to about 8.

28. The liquid detergent composition of claim 1, wherein the composition further comprises at least one antimicrobial ingredient.

29. The liquid detergent composition of claim 28, wherein the at least one antimicrobial ingredient is a member selected from the group consisting of triclosan, n-alkyl dimethyl benzyl ammonium choride, n-alkyl dimethyl benzyl ammonium choride, dialkyl dimethyl ammonium choride, didecyl dimethyl ammonium choride, dioctyl dimethyl ammonium choride, phenolics, iodophors, pine oil, methyl salicylate, morpholine, silver, copper, bromine, quaternary ammonium compounds, derivatives thereof, and combinations thereof.

30. The liquid detergent composition of claim 1, wherein the composition further comprises from 0% to about 20% by weight of at least one additive.

31. The liquid detergent composition of claim 30, wherein the at least one additive is a member selected from the group consisting of solubilizing agents, fragrances, dyes, enzymes, preservatives, polymers, thickeners, builders, magnesium sulfate, derivatives thereof, and combinations thereof.

32. The liquid detergent composition of claim 31, wherein the enzyme is a member selected from the group consisting of proteases, amylases, lipases, derivatives thereof, and combinations thereof.

33. The liquid detergent composition of claim 31, wherein the preservative is a member selected from the group consisting of benzyl alcohol, phenoxy-2-ethanol, methyl paraben, propyl paraben, Methylchloroisothiazolinone, Methylisothiazolinone, 2-methyl-4-isothiazolin-3-one, 1,2-benzisothiazolin-3-one, imidazolidinyl urea, 1,3-Dimethylol-5,5-dimethylhydantoin, derivatives thereof, and combinations thereof.

34. The liquid detergent composition of claim 31, wherein the polymer is a member selected from the group consisting of anionic polymers, hydroxyethylcelluloses, zwitterionic polymers, gelatins, xanthan gums, polysaccharides, polyethylene glycols, derivatives thereof, and combinations thereof.

35. The liquid detergent composition of claim 34, wherein the anionic polymer is a member selected from the group consisting of acrylates, derivatives thereof, and combinations thereof.

36. A composition which can reduce the viscosity of a liquid detergent, wherein the composition comprises:

about 0.1% to about 70% by weight of at least one phase stability compound having the general Formula 1:

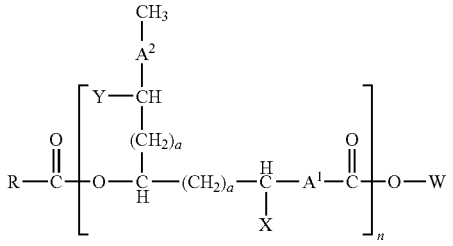

wherein the viscosity of the liquid detergent is reduced to 100 cps to 6000 cps.

* * * * *